United States Patent [19]

Kinoshita et al.

[11] Patent Number: 4,677,341

[45] Date of Patent: Jun. 30, 1987

[54] SYNCHRONOUS SCAN STREAKING DEVICE

[75] Inventors: Katsuyuki Kinoshita; Kazunori Shinoda; Masaru Sugiyama; Kouichiro Ooba; Yoshiji Suzuki, all of Hamamatsu, Japan

[73] Assignee: Hamamatsu Photonics Kabushiki Kaisha, Shizuoka, Japan

[21] Appl. No.: 703,999

[22] Filed: Feb. 21, 1985

[30] Foreign Application Priority Data

Mar. 2, 1984 [JP] Japan ..... 59-39770

[51] Int. Cl.[4] ..... H01J 29/41

[52] U.S. Cl. ..... 315/12.1; 313/438; 313/106

[58] Field of Search ..... 315/410, 12.1; 313/413, 313/417, 424, 438, 439, 106

[56] References Cited

U.S. PATENT DOCUMENTS

| | | | |
|---|---|---|---|
| 2,111,942 | 3/1938 | Schlesinger | 313/439 |
| 2,161,437 | 6/1939 | Sprague et al. | 313/438 |
| 3,395,303 | 7/1968 | Kajiyama | 313/106 |
| 3,772,553 | 11/1973 | Balint et al. | 313/439 |
| 4,511,822 | 4/1985 | Washington et al. | 313/106 |

OTHER PUBLICATIONS

"One-Sided Multipactor Discharge Modes", Journal of Applied Physics, vol. 34, No. 11, pp. 3237-3242, Nov. 1963.

"A High-Frequency Discharge in an Image Converter Tube", Vacuum, vol. 32, No. 3, pp. 141-143, 1982.

*Primary Examiner*—Theodore M. Blum
*Assistant Examiner*—David Cain
*Attorney, Agent, or Firm*—Spencer & Frank

[57] ABSTRACT

A synchronous scan streaking device comprising a photoelectric layer, an electronic lens, an anode with an aperture, a pair of deflection electrodes, and a phosphor layer arranged in order within a vacuum envelope. A deflection voltage at the same frequency as the repetition rate of the light pulses incident on the phosphor layer to be measured is fed from deflection voltage generation means to the deflection electrodes so as to repetitively generate an enhanced image of the incident light on the phosphor layer. At least one shielding metal structure which is connected to the common potential source is arranged in the space between the deflection electrode plate and the wall of the envelope, and surrounding a deflection electrode plate lead provided to connect the deflection electrode plate through the envelope to the deflection voltage generation means.

11 Claims, 15 Drawing Figures

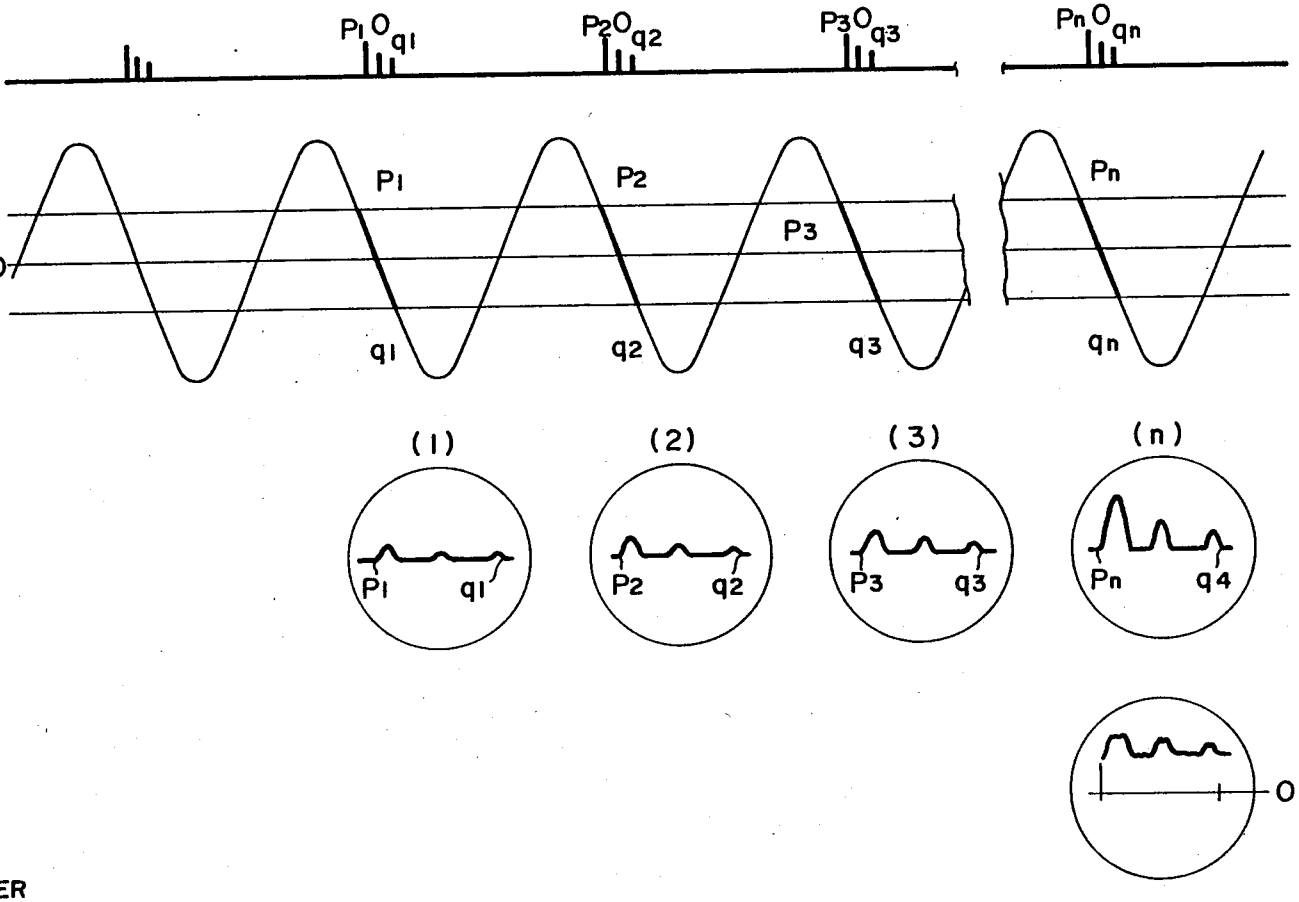
FIG. 2A FLUORESCENCE
FIG. 2B DEFLECTION VOLTAGE WAVEFORM
FIG. 2C IMAGES ON PHOSPHOR LAYER
FIG. 2D ACCUMULATED IMAGE ON PHOSPHOR LAYER

SYNCHRONOUS SCAN STREAKING DEVICE

BACKGROUND OF THE INVENTION

The present invention relates to a streaking tube, and especially to a synchronous scan streaking device which is suitable for measuring repetitive pulses of diminished light of the same waveform in the same interval.

The streaking camera is a well known device for observing the light intensity distribution with time of light pulses which may change at high speed.

The streaking tube in the streaking camera is an electron tube consisting of a photoelectric layer, a phosphor layer, and a pair of deflection electrodes arranged between the photoelectric layer and the phosphor layer.

When the light is incident on the photoelectric layer of the streaking camera, the photoelectric layer emits photoelectrons in accordance with the incident light intensity, which may change with time, to form a photoelectron beam image.

When an electric field is applied across the deflection electrodes during transportation of photoelectrons toward the phosphor layer, the photoelectron beam is scanned in line on the phosphor layer and the incident light intensity change becomes the brightness change on the phosphor layer along the photoelectron beam scanning line (on the time coordinate).

The image on the phosphor layer is called the streaking image. This type of image is photographed or taken up by a TV camera to measure the brightness distribution along the scanning line. The light intensity change with time can thus be known.

The synchronous scan streaking device utilizing this type of streaking tube structure can be used to measure the repetitive pulses of diminished light.

This type of diminished repetitive light pulses is, for instance, a series of light pulses which have occurred in a fluorescent material excited by laser beam pulses.

When the measured light pulse intensity is very small, the resulting image intensity is very small and thus an accurate light intensity distribution cannot be obtained.

If the repetitively measured light pulses are of the same waveform repeated in the same period, the streaking image of the same intensity distribution along the scanning line (on the time coordinate) can duplicatedly be put on the same location of the phosphor layer when the sine-wave voltages in the same interval as the repetitive light pulses are applied to the streaking tube deflection electrodes in a predetermined phase relation with respect to the repetitive light pulses.

Brightness of the streaking image on the phosphor layer is enhanced by "n" times the single-scan brightness if the same image is generated "n" times during scanning. This results in a satisfactory streaking image with high S/N ratio even if the streaking image intensity is very small.

The synchronous scan streaking device is one in which the principle of operation is realized in a vacuum envelope.

The inventors found that the streaking image was distorted by a multipactoring discharge occurring in a streaking tube during measurement if the measurement was carried out by using a synchronous scan streaking device in the conventional device.

A multipactoring discharge is a discharge occurring in a vacuum across the RF electric field due to secondary electron emission on the electrode surface.

The conventional synchronous scan streaking device configuration and multipactoring discharge outline will be described hereafter.

FIG. 1 shows the cutaway view of the synchronous scan streaking device in the conventional device along the optical axis of the streaking tube structure.

Photoelectric layer 2 is formed on an inside surface at the bottom of tubular vacuum envelope 1, and phosphor layer 7 on the other inner surface.

A negative DC voltage with respect to a common reference potential is applied to phosphor layer 2 from power source E2.

Mesh electrode 3 is arranged adjacent to the photoelectric layer 2. A positive DC voltage with respect to photoelectric layer 2 is applied to mesh electrode 3 from power source E1 so as to accelerate photoelectrons generated from photoelectric layer 2.

Focusing electrode 4 is arranged in a space between anode plate 5 with an aperture at the center and the mesh electrode 3.

The anode plate 5 is connected to the common reference potential and a DC voltage supplied from power source E2 through a voltage divider appears at the focusing electrode 4. When the DC voltage is applied to the focusing electrode 4, an electron beam lens is formed to focus, on phosphor layer 7, photoelectrons generated from photoelectric layer 2.

A deflection voltage which periodically changes with time is applied across a pair of deflection electrode plates from deflection voltage generation means 8.

FIGS. 2A, 2B, 2C and 2D show scanning voltage waveforms together with images on phosphor layer 7, so as to illustrate the operation of the synchronous scan streaking device configuration in the conventional device.

The deflection voltage generation means 8 in the normal synchronous scan streaking device generates such a sine-wave voltage as shown in FIG. 2B, wherein linear portions p1 to q1, p2 to q2, ... pn to qn ... in the sine-waveform can be used to deflect the electron beam.

The sine-wave signal frequency is to be set at the same value as the repetition rate of the measured light pulses and the sine-wave signal phase is to be synchronizing with the measured light pulses.

Such a sine-wave signal voltage as shown in FIG. 2B is applied to deflection electrode plates **6*a* so as to observe such fluorescence as shown in FIG. 2A**.

This sine-wave signal voltage can easily be obtained by generating another sine-wave signal voltage with the same phase at the same frequency, i.e., by using a laser beam generator to cause the fluorescence to occur.

FIG. 2C shows the light intensity distribution obtained along the time coordinate on phosphor layer 7 each time the electron beam is scanned.

The incident light beam intensity is diminished and thus the brightness changed along the time coordinate on phosphor layer 7 is very low when a deflection voltage changes along line p1 to q1. Image (1) in FIG. 2C shows this operation. One could hardly recognize this type of brightness using only the naked eye. Repetitive scanning operations increase the brightness distribution as shown in (2) and (3) of FIG. 2C. The enhanced brightness resulting from n-times of repetitive scanning operations is expected to approach n-times the brightness obtained by a single scanning operation, as shown in (n) of FIG. 2C. The background level with no signal being input in a certain condition, however, increases with the number of times of scanning operations, as shown in FIG. 2D. This increase might be caused by multipactoring discharge.

If the incident light pulses are clocked at a frequency of the order of hundred MHz in the VHF/UHF band, the sine-wave voltage to be used for scanning the electron beam should be of the order of hundred MHz.

When a VHF/UHF frequency RF voltage is applied across a pair of deflection electrodes, a multipactoring discharge can occur in a space adjacent to the deflection electrode and glass tube wall where a high frequency electric field is formed by the applied RF voltage. The multipactoring discharge area defined by S is enclosed within a broken line, as shown in FIG. 1.

The multipactoring discharge area is mainly defined by the deflection electrode plate 6*a*, the wall of the envelope 1, a deflection electrode plate lead connecting the deflection electrode plate 6*a* to the deflection voltage generation means 8 through the envelope 1, and the anode electrode 5, but it is not always limited to the area within these elements.

Light from scintillation occurring in space S, which is reflected from various portions within envelope 1, arrives at photoelectric layer 2 passing through an aperture across anode 5 and it may cause photoelectric layer 2 to generate parasitic photoelectrons.

Photoelectron emission due to any other than the signal component increases the background level on phosphor layer 7.

The multipactoring discharge excites electrons near the deflection electrode 6*a* within the space S. The excited electrons strike the deflection electrode plate at which an RF voltage is applied, the deflection electrode plate lead at which the deflection electrode plate is connected, the glass wall portion of envelope tube 1, and anode electrode 5. When an RF electromagnetic field is applied to the deflection electrode plate, the excited electrons may travel forward and back along complicated paths. Secondary electrons are emitted each time the excited electrons strike the above tube parts. As the secondary electrons increase, an avalanche breakdown may occur in space S causing a multipactoring discharge.

Edward F. Vance describes in a paper "One-Sided Multipactor Discharge Mode", Journal of Applied Physics, Vol. 34, No. 11, pp. 3237–3242 that the multiplactor discharge mode can be suppressed by limiting both the RF deflection signal frequency and amplitude to decrease secondary electrons from the surfaces of electrodes due to discharges among different electrodes.

Deflection electrode plate 6*a*, to which the deflection signal voltage is applied, in the streaking tube structure of the synchronous scan streaking device is arranged to form a discharge spaced (S in FIG. 1), together with a lead through which an external RF voltage is applied to the deflection electrode plate. In addition, these parts constitute a complicated structure to cause a multipactoring discharge, together with the glass wall and anode electrode 2 surrounding these parts.

The device structure, however, cannot easily be modified because of the complicated structure described above.

The signal voltage applied to the deflection electrode plates of the synchronous scan streaking device should have the same frequency as the light pulses to be observed, and it should change in the LF to VHF/UHF frequency range.

The scanning rate is directly proportional to the sine-wave frequency; and its scanning speed relates to the gradient of the voltage waveform and to the amplitude of the signal voltage. The signal amplitude should be set at a specific value to keep the scanning voltage linearity satisfactory with satisfactory time resolution.

Because of the above reason, the frequency and amplitude of the signal voltage applied to the deflection electrode plates cannot be limited in spite of Vance's theory cited heretofore.

In addition, alkaline metal vapor introduced into the tube during photoelectric layer fabrication adheres to the inner surface of the glass wall as well as the other electrode surfaces. This alkaline metal increases the secondary electron emissivity and makes a multipactoring discharge occur easily.

The objective of the present invention is to provide a new type of synchronous scan streaking device wherein the background level setup due to the multipactoring discharge is reduced drastically.

SUMMARY OF THE INVENTION

The synchronous scan streaking device built in accordance with the present invention is an improved version of the synchronous scan streaking device consisting of a photoelectric layer, an electronic lens, an anode with an aperture, a pair of deflection electrodes, and a phosphor layer, which are arranged in order within a vacuum envelope, wherein a deflection voltage at the same frequency as the repetition rate of the light pulses incident on the phosphor layer whereon an image is to be observed is fed from deflection voltage generation means to the deflection electrodes so as to repetitively generate an enhanced image of the incident light on the phosphor layer.

And this type of improved version employs at least one shielding metal structure, which is connected to the common potential source, arranged in a space between the deflection electrode plate and the wall of the envelope, surrounding a deflection electrode plate lead provided to connect the deflection electrode plate through the envelope to the deflection voltage generation means.

In accordance with the present invention, the synchronous scan streaking device has no background level increase on the phosphor layer even if a multipactoring discharge occurs in a space inside the shielding metal structure when a sine-wave signal voltage with an arbitrary amplitude at a frequency in the LF to VHF/UHF frequency range is applied to the defelction electrode plates.

BRIEF DESCRIPTION OF DRAWINGS

FIGS. 2A, 2B, 2C and 2D are waveform diagrams to illustrate the operation of the conventional synchronous scan streaking device shown in FIG. 1.

PREFERRED EMBODIMENTS OF THE INVENTION

The present invention will be described in detail referring to the attached drawings.

Figure 1:
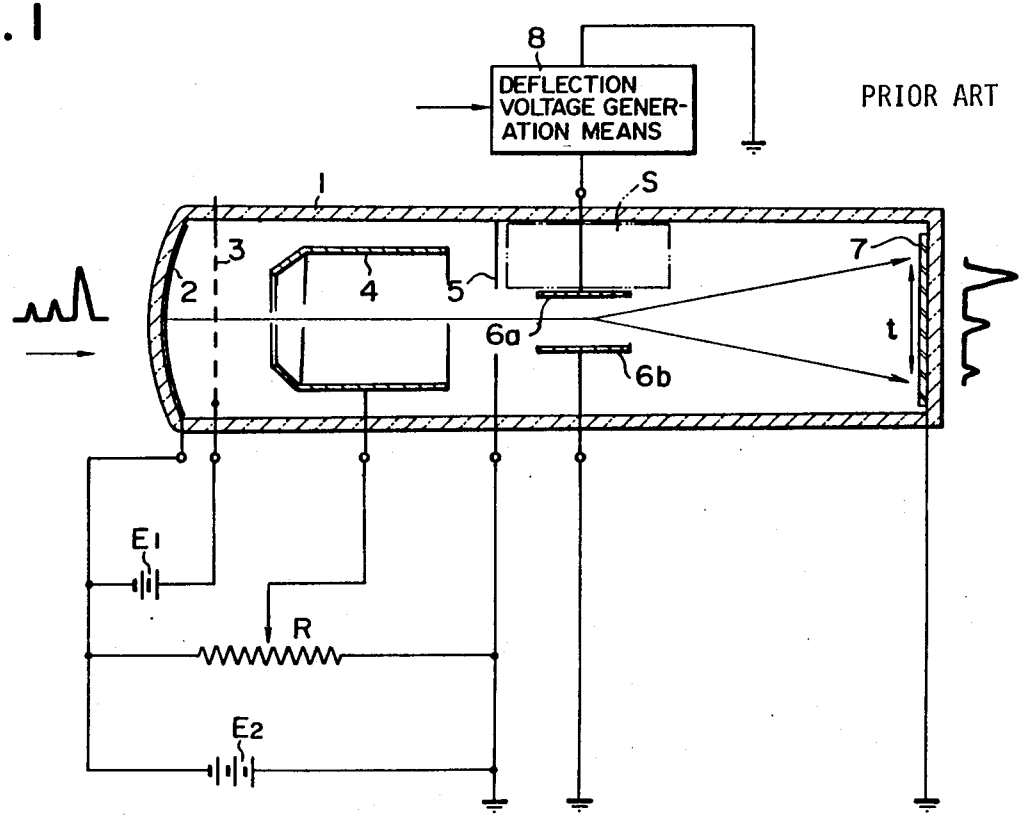
FIG. 1 shows the cutaway view of the conventional synchronous scan streaking device using a streaking tube, cut along the optical axis of the streaking tube structure.
Figure 3A:
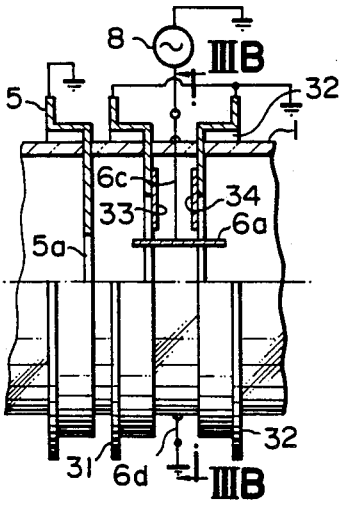
FIGS. 3A and 3B show the first preferred embodiment of the shielding metal structure related to the deflection electrode of the streaking tube structure in the synchronous scan streaking device in accordance with the present invention, FIG. 3A showing a cutaway view along the tube axis and FIG. 3B another cutaway view across the plane perpendicular to the tube axis.
Figure 3B:
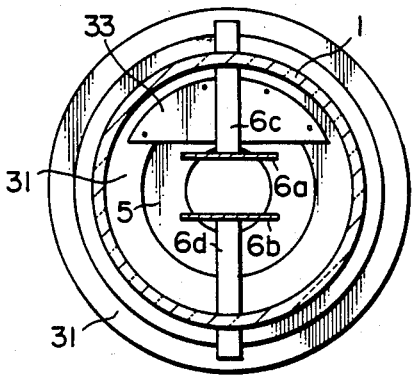

FIGS. 3A and 3B show the first preferred embodiment of the shielding metal structure related to the deflection electrode of the streaking tube structure in the synchronous scan streaking device in accordance with the present invention. The other structures are the same as those of the conventional streaking tube. FIG. 3A shows a cutaway view along the tube axis, and FIG. 3B another cutaway view across the plane perpendicular to the tube axis.

Vacuum envelope 1 is mainly composed of a glass tube with an inner diameter of approximately 40 mm.

Each of deflection electrodes 6*a* and 6*b* is made of a stainless steel plate approximately 15 mm long in the tube axis direction with a width of approximately 15 mm. Deflection electrode plate leads 6*c* and 6*d* are fastened to vacuum envelope 1 so that the distance between deflection electrode plates 6*a* and 6*b* measures 5 mm.

Each deflection electrode plate lead in the first preferred embodiment is made of an iron-nickel-cobalt alloy plate with a width of 5 mm.

Deflection electrode plate lead 6*c* is connected to deflection voltage generation means 8 and deflection electrode plate lead 6*d* is connected to the common potential source.

The shielding metal structure in the first embodiment consists of first flange 31 beside the anode electrode, second flange 32 fastened to the envelope opposite the first flange 31, and shielding metal plates 33 and 34 which are respectively fastened to the first and second flanges.

First flanges 31 together with a disk with an aperture at its center forms a dish-like structure. Second flange 32 which is of the same structure is arranged at a location opposite the first flange 31 with respect to the deflection electrode plate lead 6*c*.

Shielding plates 33 and 34 respectively forming disks are welded to flanges 31 and 32 on opposite sides of deflection electrode plate lead 6*c*.

The distance between shielding plate 33 or 34 and deflection electrode plate lead 6*c* measures approximately 3 mm, and the distance between the edge of shielding plate 33 or 34 and deflection electrode plate 6*a* measures approximately 2 mm.

Flanges 31 and 32 are connected to the common potential source, and shielding plates 33 and 34 are held at the common potential.

Figure 4A:
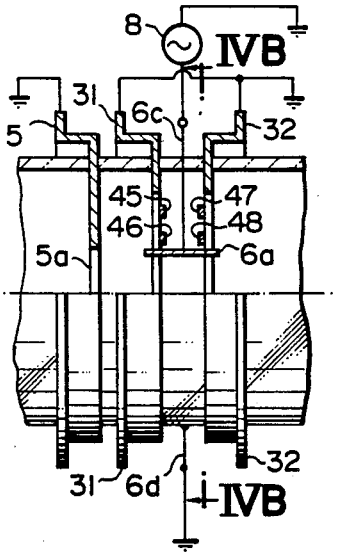
FIGS. 4A and 4B show the second preferred embodiment of the shielding metal structure related to the deflection electrode of the streaking tube structure in accordance with the present invention, FIG. 4A showing a cutaway view along the tube axis, and FIG. 4B another cutaway view across the plane perpendicular to the tube axis.
Figure 4B:
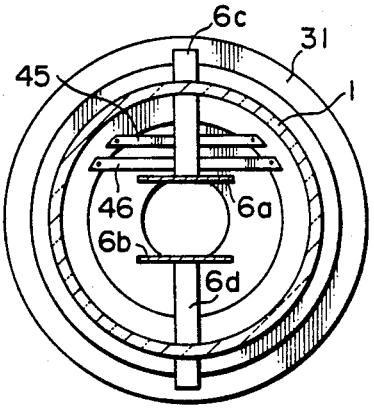

FIGS. 4A and 4B show the second preferred embodiment of the shielding metal structure related to the deflection electrode of the streaking tube structure in accordance with the present invention. FIG. 4A shows a cutaway view along the tube axis, and FIG. 4B another cutaway view across the plane perpendicular to the tube axis.

A glass tube forming vacuum envelope 1, deflection electrode plates 6*a* and 6*b*, deflection electrode plate leads 6*c* and 6*d*, and flanges 33 and 34 are the same as those elements with the same identification numbers in FIGS. 3A and 3B.

The shielding metal structure in the second preferred embodiment consists of first flange 31 beside the anode electrode, second flange 32 fastened to the envelope opposite the first flange 31, and shielding grids 45 through 48 which are respectively fastened to the first and second flanges.

First flange 31 together with a pair of metal stripes 45 and 46 which are separated by 1 mm from one another forms a dish-like shielding structure with an opening formed by deflection electrode plate 6*a*.

Second flange 32 together with a pair of metal stripes 47 and 48 which are separated by 1 mm from one another forms a dish-like shielding structure with an opening formed by deflection electrode plate 6*a*.

The shielding grids which are connected to the common potential source through the first and second flanges 31 and 32 are held at the common potential.

Figure 5A:
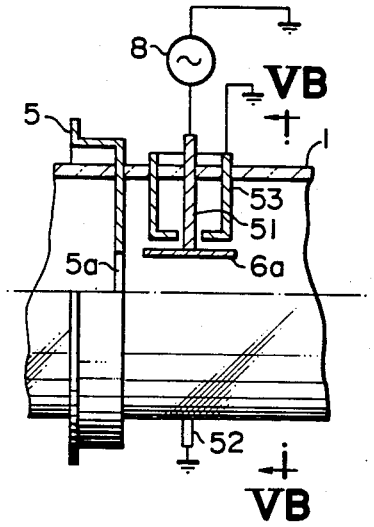
FIGS. 5A and 5B show the third preferred embodiment of the shielding metal structure related to the deflection electrode of the streaking tube structure in the synchronous scan streaking device in accordance with the present invention, FIG. 5A showing a cutaway view along the tube axis, and FIG. 5B another cutaway view across the plane perpendicular to the tube axis.
Figure 5B:
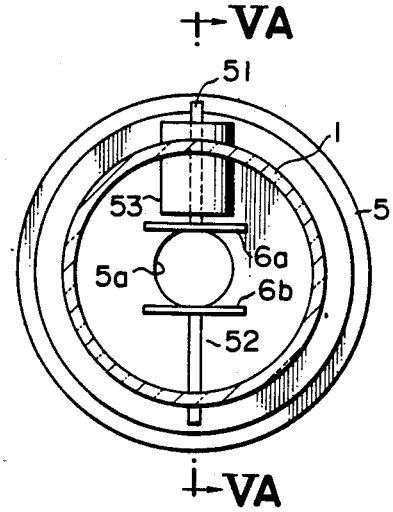

FIGS. 5A and 5B show the third preferred embodiment of the shielding metal structure related to the deflection electrode of the streaking tube structure in the synchronous scan streaking device in accordance with the present invention.

FIG. 5A shows a cutaway view along the tube axis, and FIG. 5B another cutaway view across the plane perpendicular to the tube axis.

A glass tube forming vacuum envelope 1, deflection electrode plates 6*a* and 6*b*, and other electrodes are arranged in the same manner as those of the preferred embodiments cited heretofore.

Each of deflection electrode plate leads 51 and 52 is made of an iron-nickel-cobalt alloy rod with a diameter of 1 mm.

Deflection electrode plate lead 51 is connected to deflection voltage generation means 8 and deflection electrode plate lead 52 is connected to the common potential source.

Shielding cylinder 53 enclosing deflection electrode plate lead 51 which is connected to deflection voltage generation means 8 is fastened to envelope 1.

Shielding cylinder 53 providing an inner diameter of 10 mm has a bottom plate with an aperture of 3 mm in diameter through which the deflection electrode plate lead 51 can pass.

Shielding cylinder 53 is connected to the common potential source.

Figure 6A:
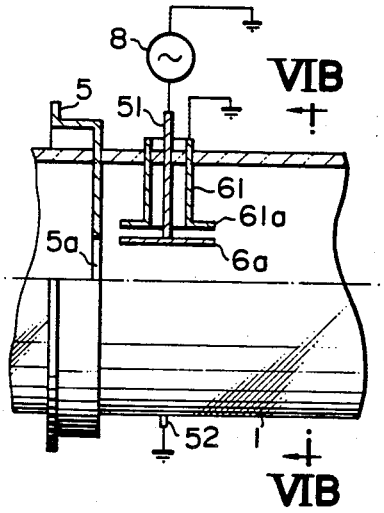
FIGS. 6A and 6B show the fourth preferred embodiment of the shielding metal structure related to the deflection electrode of the streaking tube structure in the synchronous scan streaking device in accordance with the present invention, FIG. 6A showing a cutaway view along the tube axis and FIG. 6B another cutaway view across th plane perpendicular to the tube axis.
Figure 6B:
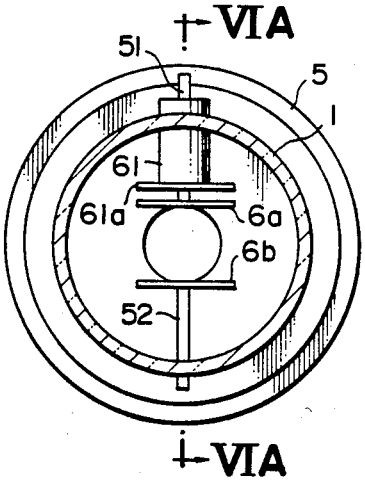

FIGS. 6A and 6B show the fourth preferred embodiment of the shielding metal structure related to the deflection electrode of the streaking tube structure in the synchronous scan streaking device in accordance with the present invention.

FIG. 6A shows a cutaway view along the tube axis, and FIG. 6B shows another cutaway view across the plane perpendicular to the tube axis.

A glass tube forming vacuum envelope 1, deflection electrode plates 6*a* and 6*b*, deflection electrode plate leads 51 and 52, and other electrodes are arranged in the same manner as those of the preferred embodiments cited heretofore.

Deflection electrode plate lead 51 is connected to deflection voltage generation means 8 and deflection electrode plate lead 52 is connected to the common potential source.

Shielding cylinder 61 with flange 61*a* at the bottom thereof, which encloses deflection electrode plate lead 51 connected to deflection voltage generation means 8, is fastened to envelope 1.

Shielding cylinder 61 providing an inner diameter of 5 mm has a bottom flange with the same structure as deflection electrode plate 6*a*, and the distance between bottom flange 61*a* and deflection electrode plate 5 measures approximately 1 mm.

Shielding cylinder 61 is connected to the common potential source in the same manner as the other preferred embodiments cited heretofore.

The following voltages are applied to the respective electrodes in the preferred embodiments cited heretofore. The diminished light pulses repetitively incident on the photoelectric layer at a repetition rate of 200 MHz are then measured under the above voltage conditions.

Photoelectric layer 2: −5 kV
Mesh electrode 3: −4 kV
Focusing electrode 4: −4.4 kV
Anode electrode 5: common
Phosphor layer 7: common
Shielding metal structure: common
Sine-wave signal voltage applied to the deflection electrodes:
Frequency: 200 MHz
Amplitude: 1.5 $kV_{p-p}$
Number of times the streaking images are scanned: $2\times10^8$/sec.

Figure 7A:
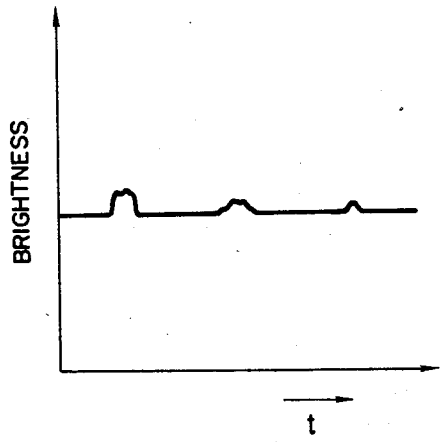
FIG. 7A is a graph showing the brightness distribution on the phosphor layer in the conventional synchronous scan streaking device and FIG. 7B shows that of the synchronous scan streaking device according to the present invention.
Figure 7B:
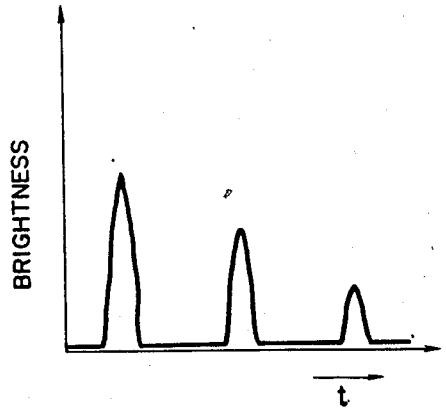

The resulting intensity distribution on phosphor layer 7 is shown in FIG. 7B. The background noise level at the peak thereof, in each preferred embodiment, is 1% or less with respect to the maximum brightness on phosphor layer 7. This background level is of a negligible order. The brightness distribution on the phosphor layer, which is obtained by the conventional synchronous scan streaking device wherein no shielding metal structure is provided, is shown in FIG. 7A as a reference.

The scope of the synchronous scan streaking device in accordance with the present invention covers a number of modifications and variations of the preferred embodiments built in accordance with the present invention.

If the other deflection electrode plate is also connected to the deflection voltage generation means but not connected to the reference voltage or common potential source when an RF sine-wave voltage is applied across a pair of deflection electrode plates, the shielding metal structure should be provided surrounding both deflection electrode plate leads.

In the preferred embodiments, the shielding metal structure is of the flange structure or cylindrical structure, however, it can be of the pin-support structure formed within a vacuum envelope.

As described heretofore, the synchronous scan streaking device built in accordance with the present invention suppresses multipactoring discharges which might increase the background noise level, providing a shielding metal structure connects to an unchanged common potential source within a space, wherein multipactoring discharges may occur, which covers the area between the deflection electrode plate and the wall of the envelope, surrounding the deflection electrode plate lead used to connect the deflection electrode plate to the sine-wave deflection voltage generation means through the envelope.

As an example, if a multipactoring discharge occurs in the conventional synchronous scan streaking device, the background noise level might approach 90% of the peak brightness level as shown in FIG. 7A.

What is claimed is:

1. A synchronous scan streaking device for receiving light pulses having a given repetition rate and generating a streaking image corresponding to said light pulses, comprising an evacuated envelope having an outer wall and a longitudinal axis;

a plurality of elements including a photoelectric layer, an electronic lens, an anode having an aperture therein, first and second deflection electrodes having a given length along the longitudinal axis of said envelope, and a phosphor layer, all of said elements being arranged sequentially along the longitudinal axis of said evacuated envelope, said photoelectric layer receiving said light pulses and emitting photoelectrons corresponding to the intensity of the incident light;

deflection voltage generator means for generating a deflection voltage having the same frequency as the repetition rate of said light pulses;

a first deflection electrode plate lead connecting said deflection voltage generator to said first deflection electrode, said lead passing through the outer wall of said envelope; and at least one shielding metal structure arranged in the space between said first deflection electrode and the outer wall of said envelope, said shielding metal structure surrounding said first deflection electrode plate lead, whereby an enhanced image of the light pulses incident on said photoelectric layer is generated on said phosphor layer.

2. A synchronous scan streaking device as claimed in claim 10, wherein said second deflection electrode is connected to a common potential source through a second deflection electrode plate lead.

3. A synchronous scan streaking device as claimed in claim 2, wherein said shielding metal structure is located adjacent said anode electrode.

4. A synchronous scan streaking device as claimed in claim 14, wherein said first and second shielding plates are a pair of shielding grids.

5. A synchronous scan streaking device as claimed in claim 2, wherein said shielding metal structure consists of a metal cylinder enclosing said first deflection electrode lead, said metal cylinder being connected to said common potential source.

6. A synchronous scan streaking device as claimed in claim 5, wherein said metal cylinder includes a bottom conductor having an aperture through which said first deflection electrode plate lead passes.

7. The synchronous scan streaking device as claimed in claim 5, wherein a flange is provided at the bottom of said metal cylinder so that said flange covers said first deflection electrode.

8. A synchronous scan streaking device as claimed in claim 1 wherein said at least one shielding metal structure includes a shielding plate having a surface which is perpendicular to the longitudinal axis of said envelope, the plane defined by said surface intersecting said deflection electrodes.

9. A synchronous scan streaking device as claimed in claim 8 which comprises two spaced shielding metal structures each including a shielding plate having a surface which is perpendicular to the longitudinal axis of said envelope, the planes defined by said surfaces intersecting said deflection electrodes.

10. A synchronous scan streaking device as claimed in claim 3, wherein said shielding metal structure comprises a first flange having an aperture therein, said first flange being fastened to said envelope and being located in the space between said first deflection electrode plate lead and said anode electrode; and a second flange, having an aperture therein, said second flange being fastened to said envelope and being located on the side of said deflection electrode plate lead opposite the side on which said first flange is located, said first and second flanges being connected to said common potential source.

11. A synchronous scan streaking device as claimed in claim 10, wherein said shielding metal structure includes first and second shielding plates affixed to said first and second flanges, said first and second shielding plates isolating said first deflection electrode plate lead from the other elements located within said envelope.

* * * * *